US005284988A

United States Patent [19]

Schaerfl, Jr. et al.

[11] Patent Number: 5,284,988

[45] Date of Patent: Feb. 8, 1994

[54] PREPARATION OF SYNTHETIC OILS FROM VINYLIDENE OLEFINS AND ALPHA-OLEFINS

[75] Inventors: Robert A. Schaerfl, Jr.; Ali M. Dadgar, both of Baton Rouge; Carroll W. Lanier, Baker, all of La.

[73] Assignee: Ethyl Corporation, Richmond, Va.

[21] Appl. No.: 938,566

[22] Filed: Aug. 28, 1992

Related U.S. Application Data

[63] Continuation of Ser. No. 772,655, Oct. 7, 1991, abandoned.

[51] Int. Cl.[5] ..... C07C 2/08

[52] U.S. Cl. ..... 585/525; 585/16; 585/510; 585/520; 585/671

[58] Field of Search ..... 585/520, 525, 643, 671

[56] References Cited

U.S. PATENT DOCUMENTS

| | | | |
|---|---|---|---|
| 2,695,327 | 11/1954 | Ziegler et al. | 260/683.15 |
| 3,576,898 | 4/1971 | Blake et al. | 260/676 |
| 3,749,560 | 7/1973 | Perilstein | 44/80 |
| 3,876,720 | 4/1975 | Heilman et al. | 260/677 R |
| 3,907,922 | 9/1975 | Heilman et al. | 585/510 |
| 4,172,855 | 10/1979 | Shubkin et al. | 585/16 |
| 4,469,912 | 9/1984 | Blewett et al. | 585/525 |
| 4,697,040 | 9/1987 | Williamson et al. | 585/666 |
| 4,973,788 | 11/1990 | Lin et al. | 585/511 |

FOREIGN PATENT DOCUMENTS

| | | | |
|---|---|---|---|
| 377306 | 7/1990 | European Pat. Off. | C10G 69/12 |

*Primary Examiner*—Asok Pal
*Assistant Examiner*—P. Achutamurthy
*Attorney, Agent, or Firm*—David M. Bunnell

[57] ABSTRACT

A synthetic oil is made by a process comprising (a) isomerizing at least a portion of a vinylidene olefin feed to form an intermediate which contains tri-substituted olefin and (b) reacting said intermediate and at least one vinyl olefin in the presence of a catalyst to form a synthetic oil which comprises a co-dimer of said vinylidene olefin and said vinyl olefin.

18 Claims, No Drawings

PREPARATION OF SYNTHETIC OILS FROM VINYLIDENE OLEFINS AND ALPHA-OLEFINS

This application is a continuation of application Ser. No. 07/772,655, filed Oct. 7, 1991, abandoned.

This invention relates generally to the preparation of synthetic oils from a combination of alkenes and more specifically to the preparation of synthetic oils by isomerizing a vinylidene olefin to form a tri-substituted olefin containing intermediate and then reacting the intermediate with a vinyl olefin to form an oil which is predominately a co-dimer of the vinylidene olefin and the vinyl olefin.

In the specification, olefins are referred to as: "alpha-olefins" or "vinyl olefins" R—CH=$CH_2$, "vinylidene olefins"

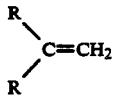

and "tri-substituted olefins"

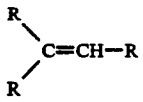

wherein R represents a hydrocarbon group.

Alpha-olefin oligomers (PAO's) derived from the catalyzed oligomerization of $C_6$ or higher alpha-olefin monomers and their use as functional fluids and synthetic lubricants are well known.

Alpha-olefins most useful in preparing synthetic base oils are mainly linear terminal olefins containing about 8–12 carbon atoms such as 1-octene, 1-decene, 1-dodecene and the like including mixtures thereof. The most preferred alpha-olefin is 1-decene or an olefin mixture containing mainly, for example, at least 75 weight percent 1-decene.

The oligomer products are mixtures which include varying amounts of dimer, trimer, tetramer, pentamer and higher oligomers of the monomers, depending upon the particular alpha-olefin, catalyst and reaction conditions. The products are unsaturated and usually have viscosities ranging from about 2 to 100 cSt and especially 2 to 15 cSt at 100° C.

The product viscosity can be further adjusted by either removing or adding higher or lower oligomers to provide a composition having the desired viscosity for a particular application. Such oligomers are usually hydrogenated to improve their oxidation resistance and are known for their superior properties of long-life, low volatility, low pour points and high viscosity indexes which make them a premier basestock for state-of-the-art lubricants and hydraulic fluids.

Suitable catalysts for making alpha-olefin oligomers include Friedel-Crafts catalyst such as $BF_3$ with a promoter such as water or an alcohol. Alternative processes for producing synthetic oils include forming vinylidene dimers of vinyl-olefins using a Ziegler catalyst, for example, as described in U.S. Pat. Nos. 2,695,327 and 4,973,788 which dimer can be further dimerized to a tetramer using a Friedel-Crafts catalyst, as described for example in U.S. Pat. Nos. 3,576,898 and 3,876,720.

One problem associated with making oligomer oils from vinyl olefins is that the oligomer product mix usually must be fractionated into different portions to obtain oils of a given desired viscosity (e.g. 2, 4, 6 or 8 cSt at 100° C.).

In commercial production it is difficult to obtain an oligomer product mix which, when fractionated, will produce the relative amounts of each viscosity product which correspond to market demand. Therefore, it is often necessary to produce an excess of one product in order to obtain the needed amount of the other.

Vinylidene olefins can be selectively dimerized and the process can be made more versatile in producing products of different viscosities as described in U.S. Pat. No. 4,172,855 where a vinylidene olefin dimer is reacted with a vinyl olefin to form a graft of the vinyl olefin onto the vinylidene olefin. Limiting factors in the selectivity of this process is that some of the vinylidene olefin will dimerize with itself and some of the vinyl olefin will react to form oligomers. This produces significant amounts of product having carbon members greater than or less than the sum of the carbon members of the vinylidene and alpha-olefin, even when using 1:1 mole ratios of relatively pure reactants.

A process has now been found which provides improved selectivity when forming synthetic oils using as starting olefins, vinylidene olefins and alpha-olefins. The products contain larger proportions (as high as 98 wt. %) of vinylidene olefin-vinyl olefin co-dimer than those produced according to the prior art processes so that product oils of a selected desired viscosity can be easily and reproduceably prepared.

In accordance with this invention there is provided a process for making a synthetic oil, said process comprising (a) isomerizing at least a portion of a vinylidene olefin feed to form an intermediate which contains tri-substituted olefin and (b) reacting said intermediate and at least one vinyl olefin in the presence of a catalyst to form a synthetic oil which comprises co-dimer of the vinylidene olefin and the vinyl olefin.

Suitable vinylidene olefins for use in the process can be prepared using known methods such as by dimerizing vinyl olefins containing from 4 to about 30 carbon atoms, preferably at least 6, and most preferably at least 8 to about 20 carbon atoms, including mixtures thereof. Such a process, which uses a trialkylaluminum catalyst, is described, for example, in U.S. Pat. No. 4,973,788, whose teachings are incorporated herein by reference. Other suitable processes and catalysts are disclosed in U.S. Pat. No. 4,172,855.

The vinylidene olefins are isomerized to tri-substituted olefins by reacting the vinylidene olefins in the presence of from about 5 to 25 wt. % of reaction mass of an isomerization catalyst for a time sufficient to convert at least about 25 wt. % and preferably at least about 50 wt. %, of the vinylidene olefins to tri-substituted olefins. Close to 100 wt. % conversions can be obtained but because the isomers are in equilibrium, some vinylidene will always be present. Suitable catalysts for the isomerization are those which, under the conditions used, cause isomerization of the vinylidene to trisubstituted olefin without causing any significant polymerization of the vinylidene. Examples of such catalysts include, but are not limited to (1) metal halides (Lewis Acids) such as $HgCl_2$, $AlCl_3$, $AlBr_3$, $CdCl_2$, $ZnCl_2$, $GaCl_3$, $TiCl_4$, $TiBr_4$, $ZrCl_4$, $SnCl_4$, $SnBr_4$, $SbCl_5$, $BrCl_3$, $FeCl_3$, $BeCl_2$, $MoCl_3$ as well as halides of Cu, Cd, and the like including combinations of such halides, (2) acidic chalcides including solid oxides (natural or synthetic) and sulfides such as alumina, silica, chromia, magnesia, molybdena, thoria, tungstic oxide, zirconia and the like or any combination of such metal oxides or sulfides. Other synthetic chalcide catalysts may include BeO, $P_2O_5$, $TiO_2$, $ThO_2$, $Al_2O_3.3SO_3$, MnO, $Mn_2O_3$, $V_2O_3$, $MoS_3$, $CrO_3.FeO_3$ and the like, (3) methathetic cation-forming agents such as $AgClO_4$, $AgBF_4$, $AgSbF_6$, $AgPF_6$, $AgAsF_6$, $AgPO_4$ and the like and (4) cation exchange resins such as sulfonated styrene divinyl-benzene cross-linked polymers. Preferred isomerization catalysts are $AlCl_3$ or silica-alumina $Al_2O_3/SiO_2$. Catalyst concentrations are not critical and the isomerization can be conveniently carried out by agitating a mixture of the vinylidene olefin and catalyst at temperatures of from about 50° to 200° C. for from about 1 to 50 hours either batchwise or in a continuous process or by passing the vinylidene through a fixed bed reactor packed with the solid catalyst.

Suitable vinyl olefins for use in the process contain from 4 to about 30 carbon atoms, and, preferably, about 6 to 24 carbon atoms, including mixtures thereof. Non-limiting examples include 1-butene, 1-pentene, 1-hexene, 1-heptene, 1-octene, 1-decene, 1-dodecene, 1-tetradecene, 1-hexadecene, 1-octadecene, 1-eicosene and the like.

The codimerization step can use any suitable oligomerization catalyst known in the art and especially Friedel-Crafts type catalysts such as acid halides (Lewis Acid) or proton acid (Bronsted Acid) catalysts. Many of the catalysts listed for the isomerization of the vinylidene olefins can also be used for the co-dimerization by selecting appropriate reaction conditions. This permits the carrying out of both steps of the process in sequence in a single fixed bed reactor such as by using the silica-alumina catalyst to pack the column or by adding the vinyl olefin monomer directly to the isomerized vinylidene intermediate containing the isomerization catalyst slurry. Examples of other suitable co-dimerization catalysts include $BF_3$, $BCl_3$, $BBr_3$, sulfuric acid, anhydrous HF, phosphoric acid, polyphosphoric acid, perchloric acid, fluorosulfuric acid, aromatic sulfuric acids, and the like. The catalysts can be used in combination and with promoters such as water, alcohols, hydrogen halide, alkyl halides and the like.

A preferred catalyst for the co-dimerization step of the process is the $BF_3$-promoter catalyst system. Suitable promoters are polar compounds and preferably alcohols containing about 1 to 8 carbon atoms such as methanol, ethanol, isopropanol, n-propanol, n-butanol, isobutanol, n-hexanol, n-octanol and the like. Other suitable promoters include, for example, water, phosphoric acid, fatty acids (e.g. valeric acid) aldehydes, acid anhydrides, ketones, organic esters, ethers, polyhydric alcohols, phenols, ether alcohols and the like. A preferred promoter is methanol. The ethers, esters, acid anhydrides, ketones and aldehydes provide good promotion properties when combined with other promoters which have an active proton e.g. water or alcohols.

Amounts of promoter are used which are effective to provide good conversions in a reasonable time. Generally amounts of 0.01 wt. % or greater, based on the total amounts of olefin reactants, can be used. Amounts greater than 1.0 wt. % can be used but are not usually necessary. Preferred amounts range from about 0.025 to 0.5 wt. % of the total amount of olefin reactants. Amounts of $BF_3$ are used to provide molar ratios of $BF_3$ to promoter of from about 0.1 to 10:1 and preferably greater than about 1:1. For example, amounts of $BF_3$ of from about 0.1 to 3.0 wt. % of the total amount of olefin reactants.

The amount of catalyst used can be kept to a minimum by bubbling $BF_3$ into an agitated mixture of the olefin reactants only until an "observable" condition is satisfied. Because the trisubstituted and/or vinylidene olefins are more reactive than vinyl olefin, less $BF_3$ catalyst is needed compared to the vinyl olefin oligomerization process normally used to produce PAO's.

The relative amounts of trisubstituted, vinylidene and vinyl olefins in the feed are varied to control the amounts of product formed through the vinyl oligomerization, vinylidene+ vinylidene, and vinylidene+vinyl pathways. Product properties are governed by the number, type, and length of branches in the olefins which comprise the product material. By altering these parameters, the properties of the final material can be varied. If more of the product is formed through the vinyl+-vinylidene pathway, the final product will have fewer and longer branches on each olefin molecule.

The process of the invention permits easy control of the factors that determine the properties the PAO product. By varying the makeup of the feed, customer-specific PAO products can be produced. If an essentially single carbon number product is desired, then about a 1:1 mole ratio of tri-substituted olefin to vinyl olefin is chosen. The carbon number of such a product can be varied by merely selecting different chain length starting olefins which add up to the desired carbon number. A wide range of molar ratios of tri-substituted olefin to vinyl olefin can be selected. Preferably ratios of from about 20:1 to 1:20 are used to provide PAO products having kinetic viscosities of from about 1 to 20 cSt at 100° C. Preferably the products contain at least about 50 weight percent co-dimer of the vinylidene olefin and vinyl olefin and, preferably, at least about 70 wt. % co-dimer.

The process can be carried out at atmospheric pressure. Moderately elevated pressures e.g. to 10 psi can be used but are not necessary because there is no need to maintain any $BF_3$ pressure in the reactor in order to get good conversions as in the case of vinyl oligomerization.

Reaction times and temperatures are chosen to efficiently obtain good conversions to the desired product. Generally, temperatures of from about −25° to 50° C. are used with reaction times of from about ½ to 5 hours.

The process is further illustrated by, but is not intended to be limited to, the following examples.

Preparation of Vinylidene Dimer

The 1-octene is dimerized to $C_{16}$ vinylidene in the presence of an aluminum alkyl, such as TNOA. The reaction mass contains 1–10 wt. % catalyst, and takes 2–20 days to convert 25–95 wt. % of the 1-octene. The reaction is carried out at temperatures between 100°–150° C., and is under minimal pressure (0 to 20 psig). The catalyst may be either neutralized with a strong base, and then phase cut from the organic material, or it may be distilled and recycled by displacing the octyl with an ethylene group in a stripping column. The unreacted octene is flashed from the $C_{16}$ vinylidene product.

Isomerization of Vinylidene Dimer

The $C_{16}$ vinylidene feed is isomerized to a $C_{16}$ tri-substituted feed in the presence of a $Al_2O_3/SiO_2$ catalyst. The wt. % catalyst is 5-25%. The catalyst/olefin mixture is heated to 50°-200° C. and agitated for 1-50 hours. This may be done continuously or batchwise. The isomerized $C_{16}$ feeds used in Examples 1-5 were prepared by heating the vinylidene for about 2-4.5 hours at 60°-90° C. with 10 wt. % catalyst to give mixtures containing about 80-99 wt. % trisubstituted olefin and 1-20 wt. % vinylidene olefin.

Preparation of 2 cSt PAO—General Procedure 2 cSt PAO products are made from hexene and $C_{16}$ vinylidene in the presence of $BF_3$:MeOH catalyst complex. 1-Hexene and $C_{16}$ vinylidene/tri-substituted olefin are fed to a reactor and mixed well. Next, 0.01-0.50 wt. % MeOH is added to the mixture. Third, $BF_3$ is bubbled through the agitated mixture until an "observable" condition is satisfied (i.e., a 1C heat kick in the reaction mass). Also, one of the reactants may be added during the reaction to increase the conversion. For example, the vinyl olefin feed can be added either continuously or in increments. $BF_3$ concentrations range from 0.1-1.0 wt. %. The mixture is reacted for 30-300 minutes and the reaction effectively stops when the agitator is turned off. The $BF_3$:MeOH is washed out of the reaction mixture with water. Two water washes are recommended and the weight of water in each wash is 10-50% of the weight of the reaction mixture. The reaction mixture and water is stirred for 10-30 minutes to allow the water to extract the $BF_3$:MeOH from the organic phase. The excess $C_6$ and $C_{16}$ is distilled away from the heavier material. The "lights" may be recycled and the "heavy" material may be used as a 2 cSt product. The flash temperature depends on the strength of the vacuum. Yields (wt. product/wt. feed) vary from 25%-90%. Also, the $C_{22}$'s may be distilled from the heavy $C_{32}$ material giving a better 2 cSt product in the distillate and heavy material, with a very low pour point, in the bottoms.

EXAMPLES 1-5

Examples 1-5 are conducted according to the general procedure for 2 cSt product with all the reactants added initially to the reaction. The specific reaction parameters for each Example 1-5 and the product compositions are provided in Table I.

TABLE I

| Example | MeOH Wt. (g) | $BF_3$ Wt. (g) | Tri[1] Wt. (g) | Vinyl Wt. (g) | Time Min. | Temperature Pot °C. | Temperature Max. °C. | Product Composition Wt. % Lights | $C_{22}$ | $C_{28}$ | $C_{32}$ | Heavies |
|---|---|---|---|---|---|---|---|---|---|---|---|---|
| 1 | 0.13 | 0.39 | 60 | 140 | 145 | 10 | 17.1 | 4.1 | 57.3 | 13.3 | 22.0 | 3.3 |
| 2 | 0.13 | 0.68 | 80 | 120 | 92 | 10 | 17.3 | 0.3 | 3.3 | 22.3 | 61.4 | 12.7 |
| 3 | 0.14 | 0.55 | 80 | 120 | 101 | 10 | 17.3 | 0.2 | 52.5 | 13.5 | 27.2 | 6.6 |
| 4 | 0.09 | 0.35 | 100 | 100 | 130 | 10 | 17.3 | 0.0 | 70.3 | 9.4 | 17.6 | 2.7 |
| 5 | 0.07 | 1.03 | 145.4 | 54.6 | 151 | 10 | 20.3 | 2.0 | 98.0 | 0.0 | 0.0 | 0.0 |

[1]Tri-substituted Olefin

The products of Examples 4 and 5 have the following properties:

| | Example 4 | Example 5 |
|---|---|---|
| Visc 100° C. | 2.43 cSt | 1.86 cSt |
| Visc 40° C. | 8.27 cSt | 5.61 cSt |
| Visc −40° C. | 653 cSt | 289 cSt |
| Pour Point °C. | <−65 | <−65 |
| Viscosity Index | 118 | — |

Preparation of 4 cSt PAO—General Procedure A

A 4 cSt PAO is made from tetradecene and $C_{16}$ vinylidene in the presence of $BF_3$:MeOH. 1-tetradecene and $C_{16}$ vinylidene/tri-substituted olefin, prepared by stirring $C_{16}$ vinylidene at 50°-200° C. for 1-50 hours (The feed for Example 6 was treated at 60°-80° C. for about 4.5 hours.) with a $Al_2O_3/SiO_2$ catalyst, are fed to a reactor and mixed well. Next, 0.01-0.50 wt. % MeOH is added to the mixture. Third, $BF_3$ is bubbled through the agitated mixture until an observable rise in temperature occurs (i.e., a 1° C. heat kick in the reaction mass). Also, one of the olefin reactants may be added during the reaction to increase the conversion. $BF_3$ concentrations range from 0.1-1.0 wt. %. The mixture is reacted for 30-300 minutes and the reaction effectively stops when the agitator is turned off. The $BF_3$:MeOH is washed out of the reaction mixture with water. Two water washes are recommended and the weight of water each wash is 10-50% of the weight of the reaction mixture. The reaction mixture and water may be stirred for 10-30 minutes to allow the water to extract the $BF_3$:MeOH from the organic phase.

The excess $C_{14}$ and $C_{16}$ is distilled away from the heavier material. The "lights" may be recycled and the "heavy" material may be used as a 4 cSt product. The flash temperature depends on the strength of the vacuum. Yields (wt. product/wt. feed) vary from 25%-90%.

EXAMPLE 6

A product made following the general procedure for 4 cSt product using 0.08 grams of MeOH, 0.48 grams of $BF_3$, 106.6 grams of $C_{16}$ tri-substituted olefin (containing 6 mol % vinylidene olefin) and 94.4 grams of $C_{14}$ vinyl olefin reacted for 140 minutes at a pot temperature of 10° C. and a maximum temperature of 16.2° C. gave as the heavy material 2.2 wt. % $C_{24}$, 90.8 wt. % $C_{28-32}$, 5.9 wt. % $C_{42}$ and 0.6 wt. % other heavies. The product has the following properties:

| | |
|---|---|
| Visc 100° C. | 3.82 cSt |
| Visc 40° C. | 16.1 cSt |
| Visc −40° C. | 1960 cSt |
| Pour Point °C. | −57° |
| Viscosity Index | 132 |

Table II compares the weight percents of $C_{14}$ and $C_{16}$ during the reaction when the process of Example 6 is run using $C_{16}$ which has not been pre-isomerized.

TABLE II

| | 0 Min. | 5 Mins. | 10 Mins. | 30 Mins. |
|---|---|---|---|---|
| Comparison | | | | |
| $C_{14}$ vinyl | 46.7 | 22.5 | 19.2 | 17.8 |
| $C_{16}$ vinylidene | 53.3 | 8.7 | 5.5 | 4.4 |
| wt. % $BF_3$ = 0.35 | | | | |
| Initial mol % vd = 52.1 | | | | |

EXAMPLE 6

| | | | | |
|---|---|---|---|---|
| $C_{14}$ vinyl | 46.7 | 38.8 | 35.6 | 32.1 |
| $C_{16}$ tri-sub | 53.3 | 41.3 | 37.2 | 32.2 |
| wt. % $BF_3$ = 0.24 | | | | |
| Initial mol % vd = 6.4 | | | | |

The rate constant for the vinylidene+vinylidene reaction is approximately ten times the constant for the vinylidene+vinyl reaction. By pre-isomerizing the vinylidenes to tri-substituted olefins, the rate of formation of $C_{32}$ from $C_{16}$ vinylidenes is greatly reduced. Moreover, as the vinylidenes are consumed, the tri-substituted olefins isomerized back because of a chemical equilibrium between the two. As seen from Table II, the consumption profiles of $C_{14}$ and $C_{16}$ are more alike in Example 6 than in the comparison. This demonstrates relatively more feed olefin consumption through the desired vinyl+vinylidene route.

EXAMPLE 7

A product was prepared by generally following the procedure of Examples 1-5 except that 1-octene was used in place of 1-hexene. The reaction mixture contained 100 grams of isomerized $C_{16}$ vinylidene, 100 grams of 1-octene, 0.09 gram MeOH and 0.66 gram of $BF_3$. The reaction time was 87 minutes, the pot temperature was 10° C. and the maximum temperature was 19.6° C. The bottoms product contained 84.7 wt. % $C_{24}$ (co-dimer), 0.0% $C_{28}$ and 13.7 wt. % $C_{32}$. The product has the following properties:

| | |
|---|---|
| Visc. 100° C. | 2.44 cSt |
| Visc. 40° C. | 8.57 cSt |
| Visc. −40° C. | 614 cSt |
| Pour Point °C. | <−65 |
| Viscosity Index | 107 |

Preparation of 4 cSt PAO—General Procedure B

A 4 cSt PAO is made from decene and $C_{20}$ vinylidene in the presence of $BF_3$:MeOH. The $C_{20}$ vinylidene comes from dimerization of 1-decene. The 1-decene is dimerized to $C_{20}$ vinylidene in the presence of an aluminum alkyl, such as TNOA. The reaction mass contains 1-10 wt. % catalyst and takes 2-20 days to convert 25 to 95% of the material. The reaction is carried out between 100°-150° C., and is under minimal pressure. The catalyst may be either neutralized with a strong base and then phase cut from the organic, or it may be distilled and recycled by displacing the octyl with an ethylene group in a stripping column. The unreacted decene is flashed from the $C_{20}$ vinylidene.

The $C_{20}$ vinylidene feed is isomerized to a $C_{20}$ tri-substituted feed in the presence of a $Al_2O_3/SiO_2$ catalyst. The wt. % catalyst is 5-25%. The catalyst/olefin mixture is heated to 50°-200° C. and agitated for about 1-50 hours. This may be done continuously or batchwise. 1-Decene and the $C_{20}$ vinylidene/tri-substituted isomerization product are fed to a reactor and mixed well. Next, 0.01-0.50 wt. % MeOH is added to the mixture. Then, $BF_3$ is bubbled through the agitated mixture until an "observable" condition is satisfied (i.e., a 1C heat kick in the reaction mass). Also, one of the reactants may be added during the reaction to increase the conversion. $BF_3$ concentrations range from 0.0-1.0 wt. %. The mixture is reacted for 30-300 minutes and the reaction effectively stops when the agitator is turned off. The $BF_3$:MeOH is washed out of the reaction mixture with water: Two water washes are recommended and the weight of water each wash is 10-50% of the weight of the reaction mixture. The reaction mixture and water should be stirred for 10-30 minutes to allow the water to extract the $BF_3$:MeOH from the organic phase.

The excess $C_{10}$ and $C_{20}$ is distilled away from the heavier material. The "lights" may be recycled and the "heavy material may be used as a 4 cSt product. The flash temperature depends on the strength of the vacuum. Yields (wt. product/feed) vary from 25-90%.

EXAMPLE 8

A product was prepared by following the general procedure B for 4 cSt product using 0.09 gram of MeOH, 0.276 gram of $BF_3$, 133.5 grams of $C_{20}$ tri-substituted olefin, and 66.6 grams of $C_{10}$ vinyl olefin reacted for 45 minutes of a pot temperature (chiller) of 10° C. and a maximum temperature of 17.8° C. The product composition in wt. % was 0.2% $C_{20}$, 83.2% $C_{30}$ and 16.5% $C_{40+}$. The product had the following properties.

| | |
|---|---|
| Visc. 100° C. | 3.65 cSt |
| Visc. 40° C. | 14.8 cSt |
| Pour Point °C. | −27° |
| Viscosity Index | 136 |

What is claimed is:

1. A process for making a synthetic oil, said process comprising (a) isomerizing at least a portion of a vinylidene olefin feed to form an intermediate which contains at least 50 wt. percent tri-substituted olefin and (b) reacting said intermediate and a vinyl olefin in the presence of a catalyst to form a synthetic oil which comprises at least about 50 wt. percent of a co-dimer having a carbon number which is the sum of the carbon numbers of the vinylidene olefin and the vinyl olefin.

2. The process of claim 1 wherein said vinylidene olefin is a dimer of a vinyl olefin monomer containing about 4 to 30 carbon atoms and said vinyl olefin contains about 4 to 30 carbon atoms.

3. The process of claim 2 wherein said vinylidene olefin is a dimer of a vinyl olefin monomer containing about 6 to 20 carbon atoms and said vinyl olefin contains about 6 to 24 carbon atoms.

4. The process of claim 2 wherein said synthetic oil is at least about 70 wt. percent reaction product of said intermediate and said vinyl olefin.

5. The process of claim 2 wherein said catalyst is a $BF_3$-promoter catalyst.

6. The process of claim 5 wherein the amount of promoter is from about 0.001 to 1.0 wt. percent promoter, based on the total weight of olefin reactants.

7. The process of claim 6 wherein the promoter is an alcohol.

8. The process of claim 7 wherein the alcohol is an aliphatic alcohol which contains from about 1–8 carbon atoms.

9. The process of claim 6 wherein the molar ratio of $BF_3$ is greater than about 1:1.

10. The process of claim 6 wherein the amount of promoter is from about 0.025 to about 0.5 wt. percent based on the total weight of olefin reactants.

11. The process of claim 2 wherein the intermediate contains at least about 95 wt. percent tri-substituted olefin and the molar ratio of tri-substituted olefin to vinyl olefin is about 1:1 such that said synthetic oil is essentially a co-dimer having a single carbon number which is the sum of the carbon numbers of the vinylidene olefin and the vinyl olefin.

12. The process of claim 1 wherein a vinylidene olefin isomerization catalyst is present in step (a).

13. The process of claim 12 wherein said isomerization catalyst is $Al_2O_3/SiO_2$.

14. The process of claim 12 wherein said isomerization catalyst is used to catalyze the step (b) reaction.

15. The process of claim 14 wherein said process is carried out in a fixed bed reactor packed with $Al_2O_3/SiO_2$ catalyst.

16. The process of claim 1 wherein said synthetic oil has a kinetic viscosity of from about 1 to 100 cSt at 100° C.

17. The process of claim 16 wherein said synthetic oil has a kinetic viscosity of from about 2 to 5 cSt at 100° C.

18. The process of claim 2 wherein the mole ratio of trisubstituted olefin to vinyl olefin is from about 20:1 to 1:20.

* * * * *

UNITED STATES PATENT AND TRADEMARK OFFICE

CERTIFICATE OF CORRECTION

PATENT NO. : 5,284,988

DATED : February 8, 1994

INVENTOR(S) : Robert A. Schaerfl, Jr., et al.

It is certified that error appears in the above-indentified patent and that said Letters Patent is hereby corrected as shown below:

Claim 9, line 5, reads, "$BF_3$ is greater than about 1:1.", but should read -- $BF_3$ to promoter is greater than about 1:1. --

Claim 17, line 14, reads, "...2 to 5 cSt at 100°C.", but should read -- ...2 to 15 cSt at 100°C. --.

Signed and Sealed this

Twelfth Day of July, 1994

Bruce Lehman

*Attest:*

BRUCE LEHMAN

*Attesting Officer*

*Commissioner of Patents and Trademarks*